US010968614B2

(12) United States Patent
Zinn et al.

(10) Patent No.: US 10,968,614 B2
(45) Date of Patent: Apr. 6, 2021

(54) ACCUMULATOR FOR VACUUM DRAINAGE SYSTEM

(71) Applicant: Acorn Engineering Company, City of Industry, CA (US)

(72) Inventors: Thomas K. Zinn, Chino Hills, CA (US); Carlos J. Galeazzi, Rancho Cucamonga, CA (US)

(73) Assignee: Acorn Engineering Company, City of Industry, CA (US)

( * ) Notice: Subject to any disclaimer, the term of this patent is extended or adjusted under 35 U.S.C. 154(b) by 81 days.

(21) Appl. No.: 16/123,885

(22) Filed: Sep. 6, 2018

(65) Prior Publication Data

US 2019/0071852 A1 Mar. 7, 2019

Related U.S. Application Data

(60) Provisional application No. 62/555,379, filed on Sep. 7, 2017.

(51) Int. Cl.

| | |
|---|---|
| ***E03C 1/12*** | (2006.01) |
| ***F25D 15/00*** | (2006.01) |
| ***E03B 5/00*** | (2006.01) |
| ***A47L 7/00*** | (2006.01) |
| ***E03F 1/00*** | (2006.01) |
| ***D06F 1/00*** | (2006.01) |
| ***A47L 5/38*** | (2006.01) |
| *F25D 21/14* | (2006.01) |

(52) U.S. Cl.

CPC ..... *E03C 1/12* (2013.01); *A47L 5/38* (2013.01); *A47L 7/0014* (2013.01); *A47L 7/0023* (2013.01); *D06F 1/00* (2013.01); *E03B 5/00* (2013.01); *E03F 1/006* (2013.01); *F25D 15/00* (2013.01); *E03C 2001/1206* (2013.01); *F25D 21/14* (2013.01)

(58) Field of Classification Search

CPC ..... Y10T 137/5762; Y10T 137/5835; Y10T 137/5907; Y10T 137/3109; B65D 1/20; E03C 1/12

See application file for complete search history.

(56) References Cited

U.S. PATENT DOCUMENTS 6,467,497 B1 10/2002 Stradinger et al.
6,990,993 B2 1/2006 Hafner et al.

*Primary Examiner* — Reinaldo Sanchez-Medina
*Assistant Examiner* — Nicole Gardner
(74) *Attorney, Agent, or Firm* — Eric J. Sosenko; Jonathan P. O'Brien; Honigman LLP

(57) ABSTRACT

An accumulator for a vacuum drainage system. The accumulator includes a body having a bottom wall, sidewalls and top wall, the bottom wall, sidewalls and top walls all cooperating to define a reservoir within the body. A first inlet port and a first outlet port are provided toward a first end of the body, and a second inlet port and a second outlet port are provided toward a second end of the body. The first and second inlet ports respectively define first and second inlet openings into the reservoir, and the first and second outlet ports respectively define first and second outlet openings from the reservoir.

22 Claims, 2 Drawing Sheets

ACCUMULATOR FOR VACUUM DRAINAGE SYSTEM

CROSS-REFERENCE TO RELATED APPLICATIONS

This application is a non-provisional patent application claiming benefit under 35 U.S.C. 119(e) of U.S. provisional patent application No. 62/555,379 filed on Sep. 7, 2017, the entire contents of which are hereby incorporated by reference.

BACKGROUND

1. Field of the Invention

The present invention generally relates to plumbing systems. More specifically, the invention relates to a waste drainage system employing a vacuum.

2. Description of Related Art

The term "wastewater" is a general term that encompasses both graywater and blackwater. Graywater is used to describe dirty process water generated from washing food, clothes and dishes, as well as bathing and other activities, but not from toilets or urinals (the latter of which is referred to as blackwater). Graywater can be generated from a variety of sources including sinks, dishwashers, clothes washers, and showers. In commercial establishments, such streams of wastewater also come from other sources, including deli and food service areas having refrigeration units, particularly refrigeration units that generate condensate or water from defrosting procedures. Water generated in this manner must be collected and disposed by the commercial establishment.

Various types of drainage systems are used to direct wastewater from a source to a common collection point. One type of system is a gravity drainage system. In a gravity feed system, gravity provides the force to move the wastewater to the collection source. Because gravity is the main motive force, the drainage conduits between the sources and the collection point must slope downward all the way from the source to the collection point in order to maintain the desired flow. Obviously, such systems require significant preplanning to ensure that the conduits are properly located. An alternative to a gravity drainage system is the vacuum drainage system. Systems of this type use a combination of gravity and vacuum to draw waste from the source to the collection point. Because the main force for movement of the wastewater is vacuum, the preplanning in the arrangement of the wastewater conduits is not as critical as in a gravity drainage system.

One component of a vacuum drainage system is the accumulator. The accumulator receives wastewater from one or more sources and stores the wastewater until a predetermined volume has been collected. Upon the volume reaching the predetermined amount, a sensor detecting the volume of the wastewater provides a signal to a controller which in turn causes vacuum to be applied to the accumulator, thereby draining volume of wastewater from the accumulator.

In certain instances, the accumulator may be integrated into a device generating the stream of wastewater. For example, accumulators are often integrated into refrigerated merchandise cases. Such cases, however, vary as to the position and location of the waste lines directing wastewater to the accumulator. Additionally, the amount of space available for integrating the accumulator, directing or redirecting waste lines to the accumulator, as well as the discharge line from the accumulator, is limited.

SUMMARY

In overcoming the enumerated drawbacks and other limitations of the related art, the present invention provides an accumulator that allows for integration into a device, such as a refrigerated merchandise case, while increasing the ease of integration and minimizing the need for modifications to the waste lines directing wastewater to and from the accumulator.

In one aspect the invention provides an accumulator for a vacuum drainage system. The accumulator including a body having a bottom wall, sidewalls and top wall, the bottom wall, sidewalls and top walls cooperating to define a reservoir within the body; a first inlet port and a first outlet port provided toward a first end of the body; a second inlet port and a second outlet port provided toward a second end of the body; and wherein the first and second inlet ports respectively define first and second inlet openings into the reservoir, and the first and second outlet ports respectively define first and second outlet openings from the reservoir.

In another aspect of the invention, the second end of the body is an opposing end to the first end of the body.

In a further aspect of the invention, the body is elongate and the accumulator is symmetrical about a vertical transverse plane defined through the body.

In an additional aspect of the invention, the accumulator oriented with the bottom wall vertically below the top wall, the first inlet opening being located at least partially above the first outlet opening and the second inlet opening being located at least partially above the second outlet opening.

In still another aspect of the invention, the bottom of the first inlet opening is located at above the top of the first outlet opening.

In a further aspect of the invention, the bottom of the second inlet opening is located above the top of the second outlet opening.

In yet additional aspect of the invention, the first inlet opening defines an effective opening area greater than a transverse, cross-sectional area of a passageway defined by the first inlet port.

In another aspect of the invention, the second inlet opening defines an effective opening area greater than a transverse, cross-sectional area of a passageway defined by the second inlet port.

In still a further aspect of the invention, the first and second inlet ports are symmetrical.

In an additional aspect of the invention, the bottom wall defines a horizontal plane and the first and second inlet ports each include a horizontal portion connected to the body by an inclined portion extending from the horizontal portion toward the bottom wall.

In another aspect of the invention, the horizontal portions are at least partially located above the top wall.

In still an additional aspect of the invention, the first inlet opening is cooperatively defined in part of the top wall and part of at least one of the sidewalls.

In yet another aspect of the invention, the second inlet opening is cooperatively defined in part of the top wall and part of at least one of the sidewalls.

In a further aspect of the invention, each of the first and second inlet openings is cooperatively defined in part of the top wall and in part of two of the sidewalls.

In still an additional aspect of the invention, the first and second outlet openings each have width between opposing ones of the sidewalls that is greater than 50% of the width between the ones of the opposing sidewalls.

In still another aspect of the invention, the first and second outlet openings each have width between opposing ones of the sidewalls that is greater than 75% of the width between the ones of the opposing sidewalls.

In yet a further aspect of the invention, the bottom wall defines a horizontal plane and the first and second outlet ports each include a horizontal portion connected to the body by an inclined portion extending from the horizontal portion toward the bottom wall.

In an additional aspect of the invention, wherein each of the inclined portion widens and flattens in shape proceeding from the horizontal portion.

In also another aspect of the invention, wherein the horizontal portion is vertically positioned closer to the top wall than to the bottom wall.

In a further aspect of the invention, wherein the first and second inlet ports are laterally offset from the first and second outlet ports relative to a longitudinal central axis through the body of the accumulator.

In an additional aspect of the invention, one of the first and second inlet ports is closed off by a closure attached thereto and one of the first and second outlet ports is closed off by a closure attached thereto.

In another aspect, the invention provides an apparatus for connecting to a vacuum drainage system. The apparatus including a source of wastewater; an accumulator coupled to the source of wastewater to receive wastewater therefrom, the accumulator having first and second inlet ports and first and second outlet ports, one of the first and second inlet ports being directly connected to the source of wastewater, one of the first and second outlet ports being configured to directly connect to the vacuum drainage system.

In another aspect, the invention provides an vacuum drainage installation including a vacuum drainage system including a vacuum source coupled to a plumbing arrangement; and an apparatus including a source of wastewater, the apparatus further including an accumulator coupled to the source of wastewater to receive wastewater therefrom, the accumulator also having first and second inlet ports and first and second outlet ports, one of the first and second inlet ports being directly connected to the source of wastewater, and one of the first and second outlet ports being directly connect to the plumbing arrangement of the vacuum drainage system.

Further objects, features and advantages of this invention will become readily apparent to persons skilled in the art after review of the following description with reference to the drawings and the claims that are appended to inform a part of this specification.

DETAILED DESCRIPTION

As used in the description that follows, directional terms such as "upper" and "lower" are used with reference to the orientation of the elements as presented in the figures. Accordingly, "upper" indicates a direction toward the top of the figure and "lower" indicates a direction toward the bottom of the figure. The terms "left" and "right" are similarly interpreted. The terms "inward" or "inner" and "outward" or "outer" indicate a direction that is generally toward or away from a central axis of the referred to part whether or not such an axis is designated in the figures. An axial surface is therefore one that faces in the axial direction. In other words, an axial surface faces in a direction along the central axis. A radial surface therefore faces radially, generally away from or toward the central axis. It will be understood, however, that in actual implementation, the directional references used herein may not necessarily correspond with the installation and orientation of the corresponding components or device.

Figure 1:
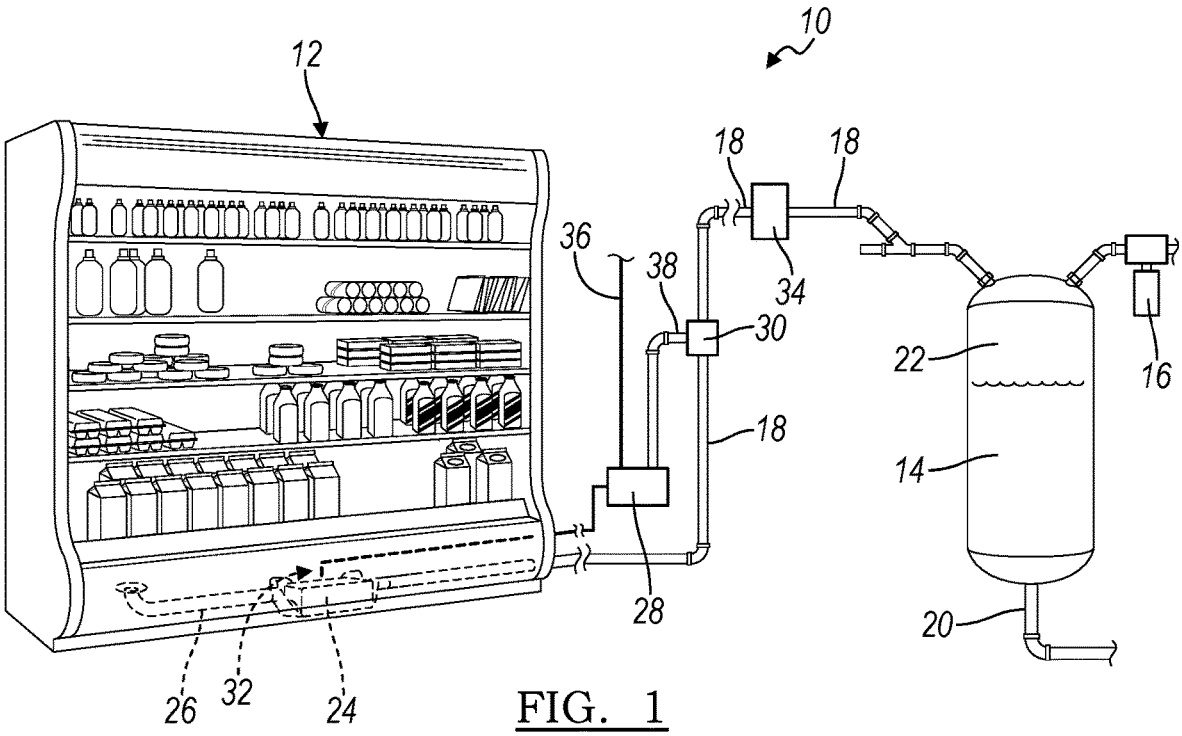
FIG. 1 is a schematic view of a vacuum drainage system incorporating the principles of the present invention.

Referring now to the drawings, a vacuum drainage system embodying the principles of the present invention is generally illustrated in FIG. 1 and designated at 10. The system 10 includes as its principal components a waste source 12, a collection tank 14, a vacuum pump 16, and a plumbing arrangement 18 comprised of a series of conduits and fittings to couple the collection tank to the waste source.

The collection tank provides a location where waste from one or more waste sources can be stored prior to periodic removal. To aid in the removal of accumulated waste, the collection tank may include a drain 20 provided at the bottom or other portion of the collection tank. Waste enters near the top of the collection tank from the plumbing arrangement. A low-pressure airspace 22 is maintained in the top of the collection tank and is connected to the vacuum pump so that air in the system is maintained in an at least partially evacuated state, thereby producing at least a partial vacuum in the plumbing arrangement. As used herein, it should be noted that terms such as "low-pressure" and "vacuum" are used interchangeably to describe a region having a pressure below the local atmospheric pressure. In addition, the term "vacuum" is understood to include partial vacuums, i.e. any pressure below atmospheric pressure.

An accumulator 24 is integrated into the waste source (illustrated in the form of a refrigerated merchandise case, but which is not limited thereto and which may be any of the aforementioned, similar or other waste sources) and receives wastewater via a waste line 26 connected to an inlet of the accumulator 24. While not shown, the waste line 26 may be coupled to a tray or other mechanism that initially collects the wastewater generated by the waste source 12. Preferably, the waste line 26 provides wastewater to the accumulator 24 under the force of gravity. The outlet of the accumulator 24 is coupled to the collection tank 14 by the plumbing arrangement 18.

The accumulator 24 is also coupled to a controller 28 that operates a control valve 30 in the plumbing arrangement 18. Upon the controller 28 receiving a signal from a sensor 32 that the accumulator 24 has accumulated a predetermined volume of wastewater, the controller 28 opens the control valve 30 and vacuum (which is present in the plumbing arrangement 18 on the downstream side of the control valve) is drawn through the plumbing arrangement 18 on the upstream side (which is normally at atmospheric pressure) of the control valve 30 and the accumulator 24. The vacuum results in a volume of wastewater from the accumulator 24 being transferred to the collection tank 14. To prevent the backflow of wastewater to the accumulator, one or more check valves 34 may be incorporated into the plumbing arrangement 18. The controller 28 may be any of the well-known variety of controllers utilized in vacuum drainage systems, one such variety being a pneumatic controller coupled by a vacuum line 36 to vacuum and by a control line 38 to the control valve 30, the latter of which may be a vacuum actuated control valve 30.

Referring now to FIGS. 2-5, the accumulator 24 is illustrated therein apart from the waste source 12. As will be appreciated from the following discussion, the present accumulator 24 readily allows for the incorporation of the accumulator 24 into a waste source without particular regard to the orientation and location of the waste line 26 from the source 12 and the outlet connecting the accumulator to the plumbing arrangement 18.

As seen in the figures, the accumulator 24 includes a bottom wall 40 connected to upstanding sidewalls 42 and closed by a top wall 44 so as to define a reservoir or chamber 45 within the accumulator 24. In a preferred embodiment, the various walls 40, 42, 44 provide the accumulator 24 with a generally elongated, rectangular shape.

Figure 2:
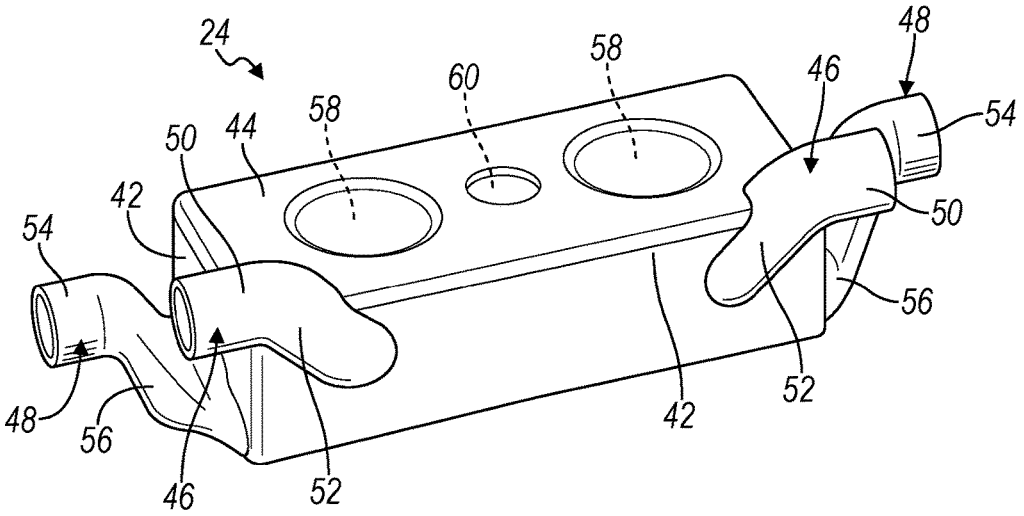
FIG. 2 is a perspective view of an accumulator incorporating the principles of and according to another aspect of the present invention.
Figure 3:
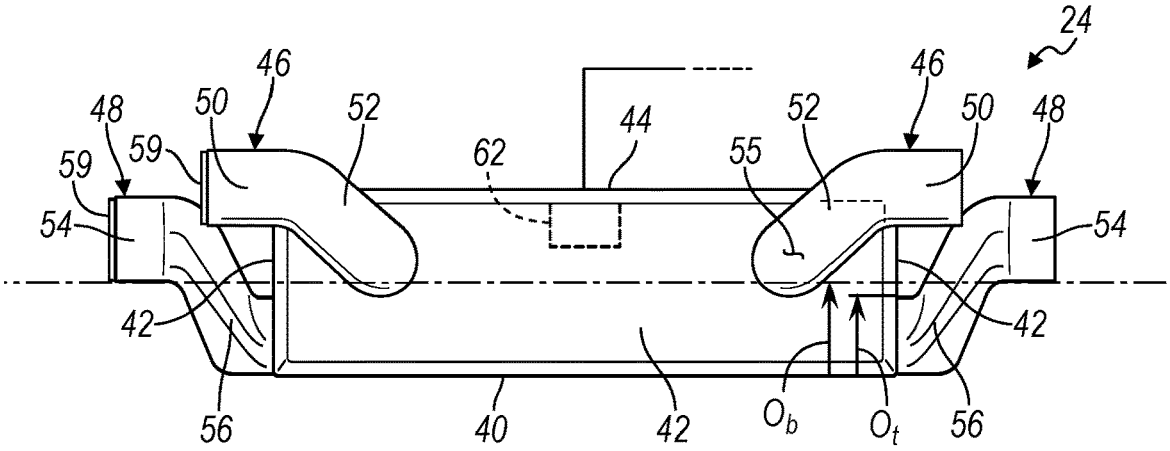
FIG. 3 is a side elevational view of the accumulator seen in FIG. 2.
Figure 4:
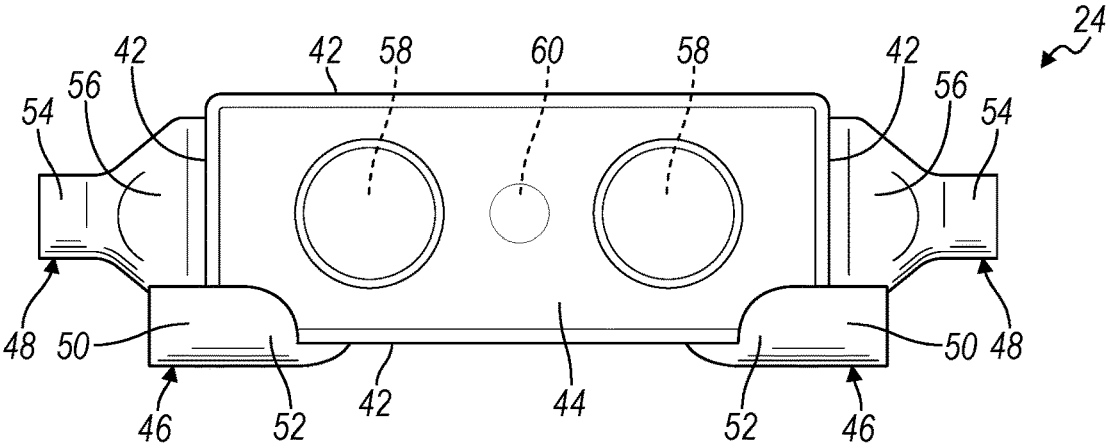
FIG. 4 is a top plan view of the accumulator seen in FIG. 2.
Figure 5:
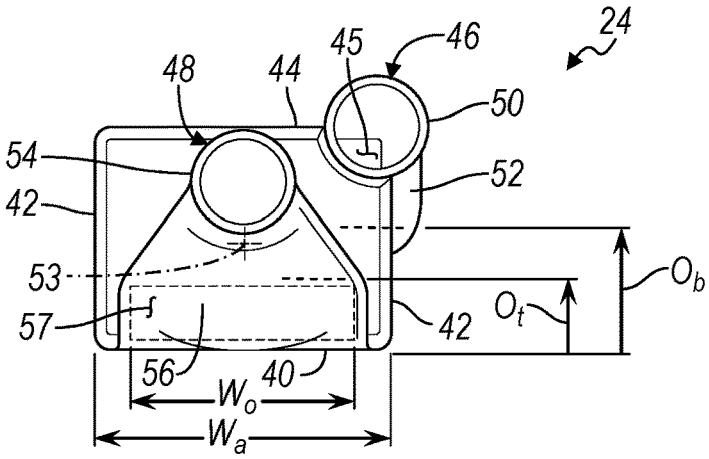
FIG. 5 is an end view of the accumulator seen in FIG. 2.

The accumulator 24 is further provided with a pair of inlet ports 46 and a pair of outlet ports 48, each of which is connected to one or more walls of the accumulator 24 and opens into the reservoir 45 defined within the accumulator 24. As seen in FIGS. 2-4, the inlet and outlet ports 46, 48 are provided as inlet/outlet pairs, generally at each of the opposing ends of the accumulator 24. Accordingly, each end of the accumulator 24 includes one inlet port 46 and one outlet port 48.

Each inlet port 46 includes a generally horizontal portion 50 and an inclined portion 52. The horizontal portion 50 extends in the direction of the length (longitudinally) of the accumulator 24, generally parallel to but offset from a central axis 53 of the accumulator 24. The inclined portions 52 extend downward from the horizontal portions 50 and define the openings of the inlet ports 46 into the reservoir 45 of the accumulator 24. In a preferred embodiment, the openings into the reservoir 45 from the inlet ports 46 are defined partially in the top wall 44 and partially in a sidewall 42. Provided in this manner, the effective area of the opening 55, which is generally delineated in FIG. 3, is greater than the transverse, cross-sectional area of the passageway defined in the horizontal and inclined portions 50, 52.

The outlet ports 48 are preferably and respectively provided at the opposing sidewalls 42 that define the ends or end walls of the accumulator 24. Similar to the inlet ports 46, each outlet port 48 includes a generally horizontal portion 54 and an inclined portion 56. The horizontal portion 54 of the outlet ports also extends generally parallel to, but offset from, the central axis 53 of the accumulator 24. The inclined portions 56 of the outlet ports 48 extend downward from the horizontal portions 54 and define the openings of the outlet ports 48 into the reservoir 45 of the accumulator 24. Generally, the horizontal portions 54 of the outlet ports 48 are cylindrical in shape. The inclined portions 56 of the outlet ports 48, however, diverge from this cylindrical shape. More specifically, proceeding from the horizontal portions 54, the inclined portions 56 widen laterally and flatten vertically. The widening, however, is to a greater extent than the flattening. This is perhaps best seen when considering FIGS. 3-5 in combination. As a result, the inclined portions 56 of the outlet ports 48 define an opening 57 into the reservoir 45 of the accumulator 24 that exhibits a width across the accumulator greater than its height. In a preferred embodiment, the width $W_o$ of this opening 57 is greater than one half the width $W_a$ of the accumulator 24, and more preferably greater three quarters the width $W_a$ of the accumulator 24. Additionally, as generally seen in FIG. 3, the top $O_t$ of the opening 57 of the outlet port 48 is preferably located below the bottom $O_b$ of the opening 55 of the inlet port 46.

Providing the accumulator 24 with inlet and outlet ports 46, 48 on each end thereof allows the accumulator 24 to be installed in the waste source 12 regardless of whether the waste line 26 is provided on the left or right hand side, or both, of the waste source 12. Similarly, connection of the outlet port of the accumulator to the plumbing arrangement can also be accommodated on the left or right hand side of the waste source 12, thereby allowing for increased flexibility in both the integrating of the accumulator 24 into the waste source 12 and the connecting of the accumulator 24 to the plumbing arrangement 18. Prior to installation, the inlet and outlet ports 46, 48 that are not to be connected to the waste line 26 and the plumbing arrangement 18 may be sealed off by an appropriate closure or cap 59 attached to the respective horizontal portions 50, 54. The closure 59 may be secured to the unused inlet and outlet ports 46, 48 by various means, including mechanical (threads), material (welding or soldering) or chemical (adhesives and solvent cement) means, and may partially extend along (exteriorly or interiorly) the horizontal portions 50, 54 or just cover the ends of the unused ports 46, 48. Closures 59 are representatively shown on the left hand side input and output ports 46, 48 of FIG. 3 as flat disk shaped members secured over the openings into the horizontal portions 50, 54.

In addition to the inlet and outlet ports 56, 58, the accumulator 24 is further provided with an air intake 58 and a sensor fitting 60. In the illustrated drawings, the air intake 58 and sensor fitting 60 are depicted by circular depressions in the top wall of the accumulator 24. The air intake 58 establishes communication between the reservoir 45 and ambient air such that, when vacuum is applied to the accumulator 24, atmospheric pressure forces the wastewater through the outlet port 58, into the plumbing arrangement 18 and toward the collection tank 14. The sensor fitting 60 allows for the incorporation of a sensor 62 (representatively shown in FIG. 3) to detect the volume or level of wastewater in the reservoir 45 of the accumulator 24. The air intake 58 and sensor fitting 60 are not predefined as openings in the top wall 44 of the accumulator 24, but are instead cut out during installation, thereby providing the accumulator 24 with greater versatility for integration with a wide variety of different waste sources 12.

As a person skilled in the art will really appreciate, the above description is meant as an illustration of at least one implementation of the principles of the present invention. This description is not intended to limit the scope or application of this invention since the invention is susceptible to modification, variation and change without departing from the spirit of this invention, as defined in the following claims.

We claim:

1. An accumulator for a vacuum drainage system comprising:

a body having a bottom wall, sidewalls and top wall, the bottom wall, sidewalls and top walls cooperating to define a reservoir within the body;

a first inlet port and a first outlet port provided toward a first end of the body;

a second inlet port and a second outlet port provided toward a second end of the body;

wherein the first and second inlet ports are symmetrical and respectively define with the body first and second inlet openings into the reservoir; and wherein the first and second outlet ports respectively define with the body first and second outlet openings from the reservoir.

2. The accumulator according to claim 1, wherein the second end of the body is an opposing end to the first end of the body.

3. The accumulator according to claim 1, wherein the body is elongate and the accumulator is symmetrical about a vertical transverse plane defined through the body.

4. The accumulator according to claim 1, wherein the first inlet opening defines an effective opening area greater than a transverse, cross-sectional area of a passageway defined by the first inlet port.

5. The accumulator according to claim 1, wherein the second inlet opening defines an effective opening area greater than a transverse, cross-sectional area of a passageway defined by the second inlet port.

6. The accumulator according to claim 1, wherein the first inlet opening is cooperatively defined by at least part of the top wall and at least part of at least one of the sidewalls.

7. The accumulator according to claim 6, wherein the second inlet opening is cooperatively defined by at least part of the top wall and at least part of at least one of the sidewalls.

8. The accumulator according to claim 1, wherein each of the first and second inlet openings is cooperatively defined by at least part of the top wall and at least part of two of the sidewalls.

9. The accumulator according to claim 1, wherein the first and second outlet openings each have width between opposing ones of the sidewalls that is greater than 50% of the width between the ones of the opposing sidewalls.

10. The accumulator according to claim 1, wherein the first and second outlet openings each have width between opposing ones of the sidewalls that is greater than 75% of the width between the ones of the opposing sidewalls.

11. The accumulator according to claim 1, wherein one of the first and second inlet ports is closed off by a closure attached thereto and wherein one of the first and second outlet ports is closed off by a closure attached thereto.

12. The accumulator according to claim 1, wherein the accumulator is incorporated into a vacuum drainage installation comprising:

a vacuum drainage system including a vacuum source coupled to a plumbing arrangement; and an apparatus including a source of wastewater, the accumulator being coupled to the source of wastewater to receive wastewater therefrom, one of the first and second inlet ports being directly connected to the source of wastewater, and one of the first and second outlet ports being directly connect to the plumbing arrangement.

13. The accumulator according to claim 1, wherein the accumulator is incorporated into an apparatus for connecting to a vacuum drainage system, the apparatus comprising:

a source of wastewater; and the accumulator being coupled to the source of wastewater to receive wastewater therefrom, one of the first and second inlet ports being directly connected to the source of wastewater, and one of the first and second outlet ports being configured to directly connect to the vacuum drainage system.

14. An accumulator for a vacuum drainage system comprising: a body having a bottom wall, sidewalls and top wall, the bottom wall, sidewalls and top walls cooperating to define a reservoir within the body; a first inlet port and a first outlet port provided toward a first end of the body; a second inlet port and a second outlet port provided toward a second end of the body; the first and second inlet ports respectively defining, with the body, first and second inlet openings into the reservoir, the first and second outlet ports respectively defining, with the body, first and second outlet openings from the reservoir; and with the accumulator oriented with the bottom wall vertically below the top wall, the first inlet opening being located at least partially above the first outlet opening and the second inlet opening being located at least partially above the second outlet opening.

15. The accumulator according to claim 14, wherein the bottom of the first inlet opening is located above the top of the first outlet opening.

16. The accumulator according to claim 15, wherein the bottom of the second inlet opening is located above the top of the second outlet opening.

17. An accumulator for a vacuum drainage system comprising:

a body having a bottom wall, sidewalls and a top wall, the bottom wall, sidewalls and top walls cooperating to define a reservoir within the body;

a first inlet port and a first outlet port provided toward a first end of the body;

a second inlet port and a second outlet port provided toward a second end of the body;

wherein the first and second inlet ports respectively define with the body first and second inlet openings into the reservoir, and the first and second outlet ports respectively define with the body first and second outlet openings from the reservoir; and the bottom wall defining a horizontal plane and the first and second inlet ports each include a horizontal portion connected to the body by an inclined portion extending from the horizontal portion toward the bottom wall.

18. The accumulator according to claim 17, wherein the horizontal portions are at least partially located above the top wall.

19. An accumulator for a vacuum drainage system comprising:

a body having a bottom wall, sidewalls and a top wall, the bottom wall, sidewalls and top walls cooperating to define a reservoir within the body;

a first inlet port and a first outlet port provided toward a first end of the body;

a second inlet port and a second outlet port provided toward a second end of the body;

wherein the first and second inlet ports respectively define with the body first and second inlet openings into the reservoir, and the first and second outlet ports respectively define with the body first and second outlet openings from the reservoir; and the bottom wall defines a horizontal plane and the first and second outlet ports each include a horizontal portion connected to the body by an inclined portion extending from the horizontal portion toward the bottom wall.

20. The accumulator according to claim 19, wherein each of the inclined portion widens and flattens in shape proceeding from the horizontal portion.

21. The accumulator according to claim 19, wherein the horizontal portions are vertically positioned closer to the top wall than to the bottom wall.

22. An accumulator for a vacuum drainage system comprising:

a body having a bottom wall, sidewalls and top wall, the bottom wall, sidewalls and top walls cooperating to define a reservoir within the body;

a first inlet port and a first outlet port provided toward a first end of the body;

a second inlet port and a second outlet port provided toward a second end of the body;

the first and second inlet ports respectively defining, with the body, first and second inlet openings into the reservoir, the first and second outlet ports respectively defining, with the body, first and second outlet openings from the reservoir; and the first and second inlet ports being laterally offset from the first and second outlet ports relative to a longitudinal central axis through the body of the accumulator.

* * * * *